US011754936B2

(12) United States Patent
Watanabe et al.

(10) Patent No.: US 11,754,936 B2
(45) Date of Patent: Sep. 12, 2023

(54) WAX FOR TONERS FOR DEVELOPING ELECTROSTATIC IMAGES, AND TONER FOR DEVELOPING ELECTROSTATIC IMAGES CONTAINING THE WAX

(71) Applicants: ZEON CORPORATION, Tokyo (JP); NOF CORPORATION, Tokyo (JP)

(72) Inventors: Masashi Watanabe, Tokyo (JP); Takeshi Yoshimura, Amagasaki (JP); Norifumi Itako, Amagasaki (JP)

(73) Assignees: ZEON CORPORATION, Tokyo (JP); NOF CORPORATION, Tokyo (JP)

( * ) Notice: Subject to any disclaimer, the term of this patent is extended or adjusted under 35 U.S.C. 154(b) by 255 days.

(21) Appl. No.: 17/283,088

(22) PCT Filed: Oct. 7, 2019

(86) PCT No.: PCT/JP2019/039434
§ 371 (c)(1),
(2) Date: Apr. 6, 2021

(87) PCT Pub. No.: WO2020/075660
PCT Pub. Date: Apr. 16, 2020

(65) Prior Publication Data

US 2021/0341852 A1 Nov. 4, 2021

(30) Foreign Application Priority Data

Oct. 10, 2018 (JP) ..... 2018-191815

(51) Int. Cl.
*G03G 9/087* (2006.01)
*G03G 9/097* (2006.01)
*G03G 9/08* (2006.01)

(52) U.S. Cl.
CPC ..... *G03G 9/09733* (2013.01); *G03G 9/0819* (2013.01)

(58) Field of Classification Search
CPC ..... G03G 9/08782
See application file for complete search history.

(56) References Cited

U.S. PATENT DOCUMENTS

2016/0048090 A1 2/2016 Masuda et al.
2017/0371256 A1* 12/2017 Shirai ..... G03G 9/08784

FOREIGN PATENT DOCUMENTS

| | | | | |
|---|---|---|---|---|
| CN | 101866120 | * | 3/2015 | ..... G03G 9/08 |
| JP | H10-282822 A | | 10/1998 | |
| JP | H11-218960 A | | 8/1999 | |
| JP | 2008-299010 A | | 12/2008 | |
| JP | 2009-288381 A | | 12/2009 | |
| JP | 2010-134156 A | | 6/2010 | |
| JP | 2018-141919 A | | 9/2018 | |
| JP | 2018-141919 | * | 2/2023 | ..... G03G 9/08 |
| WO | 2014/157424 A1 | | 10/2014 | |

OTHER PUBLICATIONS

Translation of JP 2018-141919.*
Translation of CN 101866120.*
Notification of Transmittal of Translation of the International Preliminary Report on Patentability (Form PCT/IB/338) issued in counterpart International Application No. PCT/JP2019/039434 dated Apr. 22, 2021 with Forms PCT/IB/373 and PCT/ISA/237. (6 pages).
Indian Office Action dated Dec. 26, 2022, issued in counterpart IN Application No. 202117016188, with English translation. (5 pages).
The Extended European Search Report dated Jun. 7, 2022, issued in counterpart EP Application No. 19871840.5. (5 pages).

* cited by examiner

*Primary Examiner* — Peter L Vajda
(74) *Attorney, Agent, or Firm* — WHDA, LLP

(57) ABSTRACT

Provided is a wax which is used in a toner, whereby the toner is excellent in low-temperature fixability and heat-resistant shelf stability, the glossiness is improved as compared with the prior art, and the generation of ultrafine particles and the bleeding of the wax are not likely to occur. The wax for toners, wherein the wax is an ester wax generated by esterification of a pentaerythritol and a monocarboxylic acid; wherein the monocarboxylic acid used for the esterification contains a behenic acid, an arachidic acid and a stearic acid; and wherein, with respect to 100% by mass of the monocarboxylic acid, a content ratio of the behenic acid is from 60% by mass to 80% by mass; a content ratio of the arachidic acid is from 5% by mass to 15% by mass; and a content ratio of the stearic acid is from 15% by mass to 25% by mass.

7 Claims, No Drawings

WAX FOR TONERS FOR DEVELOPING ELECTROSTATIC IMAGES, AND TONER FOR DEVELOPING ELECTROSTATIC IMAGES CONTAINING THE WAX

TECHNICAL FIELD

The present disclosure relates to a wax for toners for developing electrostatic images (hereinafter, it may be simply referred to as "toner") which is used to develop an electrostatic latent image in, for example, electrophotography, electrostatic recording, and electrostatic printing. The present disclosure also relates to a toner containing the wax.

BACKGROUND ART

In a toner used in a general electrophotographic method, a releasing agent is contained in the surface of the colored resin particles, whereby the toner exhibits a releasing effect. In particular, in a wet toner, a releasing agent collects on the surface of a droplet of a polymerizable monomer composition in a manufacturing process thereof, so that a large amount of the releasing agent is distributed on the surface of the colored resin particles. As the releasing agent, a fatty acid, a fatty acid salt, a fatty acid ester (wax) or the like has been widely used.

For example, Patent Literature 1 discloses a toner for developing electrostatic images, the toner containing a eutectic of an ester wax and a petroleum wax as a releasing agent. In Patent Literature 1, it is described that such a toner composition can optimize the balance of shelf stability (blocking resistance), hot offset resistance, and low temperature fixability of the resulting toner.

Patent Literature 2 discloses a core-shell type polymerized toner in which a core particle composed of a colored polymer particle containing a polyfunctional ester compound, a Fischer-Tropsch wax and a colorant is coated with a shell composed of a polymer having a glass transition temperature higher than the glass transition temperature of the polymer component constituting the core particle. In Patent Literature 2, it is described that such a toner is excellent in shelf stability, can be fixed at a lower temperature than normal, has a wide non-offset width, is excellent in printing properties, and exhibits excellent fixability even in high-speed printing or high-speed copying.

Patent Literature 3 discloses a non-magnetic toner in which 5 parts by weight to 40 parts by weight of a material having a low softening point is contained with respect to 100 parts by weight of a binder resin, in which the physical properties of the THF-insoluble portion of the toner and the storage elastic modulus of the toner fall within predetermined ranges, and in which the amount of the toner discharged in 10 minutes is from 0.5 g to 15 g at a melt index (temperature of 125° C., and a load of 5 kg). In Patent Literature 3, it is described that such a non-magnetic toner has good developability and excellent low-temperature fixability and offset resistance, and it provides high-quality images with excellent transparency such as images on films for overhead projectors (OHP).

Patent Literature 4 discloses a toner for developing electrostatic images, in which 95% by mass to 99% by mass of a monoester compound A having a structure of the following formula (1) and 1% by mass to 5% by mass of a monoester compound B having a structure of the following formula (2) are contained as a softening agent, and in which the content of the softening agent is from 10 parts by mass to 30 parts by mass with respect to 100 parts by mass of a binder resin:

$$R^1—COO—R^2 \quad \text{Formula (1)}$$

where $R^1$ is a straight-chain alkyl group having from 17 to 23 carbon atoms; $R^2$ is a straight-chain alkyl group having from 16 to 22 carbon atoms; and the total carbon number of $R^1$ and $R^2$ is 39, $$R^3—COO—R^4 \quad \text{Formula (2)}$$

where $R^3$ is a straight-chain alkyl group having from 15 to 21 carbon atoms; $R^4$ is a straight-chain alkyl group having 16 to 22 carbon atoms; and the total carbon number of $R^3$ and $R^4$ is from 35 to 37.

In Patent Literature 4, it is descried that a toner which is excellent in a balance between heat-resistant shelf stability and low-temperature fixability and which is excellent in hot offset resistance, is provided since the monoester compounds A and B are contained in the predetermined ratios as the softening agent, and since the softening agent is further contained in the predetermined ratio with respect to the binder resin.

CITATION LIST

Patent Literature

Patent Literature 1: Japanese Patent Application Laid-Open (JP-A) No. 2008-299010
Patent Literature 2: JP-A No. H11 (1999)-218960
Patent Literature 3: JP-A No. H10 (1998)-282822
Patent Literature 4: PCT International Patent Laid-Open No. 2014/157424

SUMMARY OF INVENTION

Technical Problem

However, the toner described in Patent Literature 1 has a problem of insufficient gloss. The toner described in Patent Literature 2 has a problem with gloss and is insufficient in low-temperature fixability. With the technique described in Patent Literature 3, it is difficult to obtain a toner having a good balance of low-temperature fixability, gloss and shelf stability. The toner described in Patent Literature 4 has a problem in that the softening agent is likely to bleed during storage at high temperature.

An object of the present disclosure is to provide a wax which is used in a toner, whereby the toner is excellent in low-temperature fixability and heat-resistant shelf stability, the glossiness is improved as compared with the prior art, and the generation of ultrafine particles and the bleeding of the wax are not likely to occur. Another object of the present disclosure is to provide a toner for developing electrostatic images, which contains the wax.

Solution to Problem

The inventors of the present disclosure found that the above-mentioned problems can be solved by using a specific wax for toners for developing electrostatic images.

The wax of the present disclosure is a wax for toners for developing electrostatic images, wherein the wax is an ester wax generated by esterification of a pentaerythritol and a monocarboxylic acid;

wherein the monocarboxylic acid used for the esterification contains a behenic acid, an arachidic acid and a stearic acid; and wherein, with respect to 100% by mass of the monocarboxylic acid, the content ratio of the behenic acid is from 60% by mass to 80% by mass; the content ratio of the arachidic acid is from 5% by mass to 15% by mass; and the content ratio of the stearic acid is from 15% by mass to 25% by mass.

The toner for developing electrostatic images according to the present disclosure, is a toner comprising colored resin particles containing a binder resin, a colorant and a wax, wherein, as the wax, the toner contains the above-mentioned wax for toners for developing electrostatic images.

The toner for developing electrostatic images according to the present disclosure may further contain a hydrocarbon wax as the wax.

In the toner for developing electrostatic images according to the present disclosure, the hydrocarbon wax may contain two or more kinds of wax molecules; a wax molecule contained the most in the hydrocarbon wax may have from 35 to 55 carbon atoms; and the melting point of the hydrocarbon wax may be from 60° C. to 85° C.

In the toner for developing electrostatic images according to the present disclosure, the hydrocarbon wax may be a paraffin wax.

In the toner for developing electrostatic images according to the present disclosure, the content of the wax may be from 5 parts by mass to 30 parts by mass, with respect to 100 parts by mass of the binder resin.

In the toner for developing electrostatic images according to the present disclosure, the ½ outflow temperature $T_{1/2}$ of the toner measured by a flow tester may be from 125° C. to 135° C., and the volume average particle diameter Dv of the toner may be from 5.5 μm to 6.5 μm, and the particle size distribution Dv/Dp of the toner may be from 1.10 to 1.16.

Advantageous Effects of Invention

According to the present disclosure as described above, the wax which is used in a toner for developing electrostatic images, whereby the toner is excellent in low-temperature fixability and heat-resistant shelf stability, the glossiness is more improved than ever before, and the generation of ultrafine particles and the bleeding of the wax are not likely to occur, is provided.

DESCRIPTION OF EMBODIMENTS

I. Wax for Toners for Developing Electrostatic Images

The wax of the present disclosure is a wax for toners for developing electrostatic images, wherein the wax is an ester wax generated by esterification of a pentaerythritol and a monocarboxylic acid; wherein the monocarboxylic acid used for the esterification contains a behenic acid, an arachidic acid and a stearic acid; and wherein, with respect to 100% by mass of the monocarboxylic acid, the content ratio of the behenic acid is from 60% by mass to 80% by mass; the content ratio of the arachidic acid is from 5% by mass to 15% by mass; and the content ratio of the stearic acid is from 15% by mass to 25% by mass.

The wax for toners for developing electrostatic images according to the present disclosure, is the ester wax generated by the esterification of the pentaerythritol and the monocarboxylic acid. The monocarboxylic acid used for the esterification contains the behenic acid (CAS No. 112-85-6, $CH_3(CH_2)_{20}COOH$), the arachidic acid (CAS No. 506-30-9, $CH_3(CH_2)_{18}COOH$) and the stearic acid (CAS No. 57-11-4, $CH_3(CH_2)_{16}COOH$). In the esterification reaction, since the monocarboxylic acid (hereinafter also referred to as "raw material monocarboxylic acid") used as a raw material thereof is a mixture, the resulting ester wax (the wax for toners for developing electrostatic images according to the present disclosure) is also a mixture.

When the raw material monocarboxylic acid contains a behenic acid having a relatively large carbon number, the bleeding of the wax in the obtained toner can be suppressed and the generation of ultrafine particles can be suppressed. When the raw material monocarboxylic acid contains an arachidic acid having a relatively small carbon number and a stearic acid having a relatively small carbon number, compatibility between the wax and the binder resin can be improved, and the coarsening of the obtained toner particles can be suppressed, when the wax for toners for developing electrostatic images is used in a toner for developing electrostatic images.

The content ratio of the behenic acid is from 60% by mass to 80% by mass, the content ratio of the arachidic acid is from 5% by mass to 15% by mass, and the content ratio of the stearic acid is from 15% by mass to 25% by mass, with respect to 100% by mass of the monocarboxylic acid used in the esterification reaction. The content ratio of the three kinds of monocarboxylic acids is within the above ranges, whereby the compatibility between the obtained wax for toners for developing electrostatic and the binder resin can be further improved, and the bleeding of the wax and the generation of ultrafine particles in the toner can be efficiently suppressed.

The content ratio of the behenic acid is preferably from 62% by mass to 78% by mass, and more preferably from 63% by mass to 75% by mass.

The content ratio of the arachidic acid is preferably from 6% by mass to 14% by mass, and more preferably from 7% by mass to 12% by mass.

The content ratio of the stearic acid is preferably from 17% by mass to 24% by mass, and more preferably from 18% by mass to 23% by mass.

Since almost all of the raw material monocarboxylic acid is used in the esterification reaction, the amount of each monocarboxylic acid used in the esterification reaction can be regarded as the amount of the structure derived from each monocarboxylic acid in the obtained ester wax.

The type and abundance ratio of the wax actually contained in the wax (mixture) for toners for developing electrostatic images, that is, the structure derived from the monocarboxylic acid in the ester wax and the content ratio thereof, can be estimated by a known method.

The amount of the raw material monocarboxylic acid and pentaerythritol used in the esterification reaction is not particularly limited. In general, they are adjusted so that the entire raw material monocarboxylic acid is from 1.0 to 1.1 molar equivalents of the pentaerythritol.

The esterification reaction can be carried out by a known method. Examples of the esterification reaction are as follows.

The pentaerythritol, the behenic acid, the arachidic acid and the stearic acid are added to a reaction vessel equipped with a thermometer, a nitrogen introducing tube, a stirrer, a Dean-Stark trap and a gymrot cooling tube, and the reaction is carried out at 220° C. under a nitrogen flow for 20 hours while water produced by the reaction is distilled off, thereby obtaining an esterified crude product. The mixing ratio of the pentaerythritol, the behenic acid, the arachidic acid and the stearic acid is appropriately adjusted so as to obtain the above-mentioned wax for toners for developing electrostatic images. By appropriately performing deoxidation and water washing on the esterified crude product, the target wax for toners for developing electrostatic images is obtained.

The melting point of the wax for toners for developing electrostatic images may be from 60° C. to 95° C., or from 70° C. to 85° C. Since the melting point of the wax for toners for developing electrostatic images is from 60° C. to 95° C., the bleeding of the wax can be suppressed during the storage of the toner, and the heat-resistant shelf stability of the toner can be improved.

The melt viscosity at 130° C. of the wax for toners for developing electrostatic images, may be from 7.5 mPa·s to 10 mPa·s, or from 8.0 mPa·s to 9.5 mPa·s. When the melt viscosity at 130° C. of the wax for toners for developing electrostatic images is from 7.5 mPa·s to 10 mPa·s, the suppression of the bleeding during the toner storage and an improvement of exudation from the fixed toner can be achieved. As a result, both excellent low-temperature fixability and excellent glossiness can be achieved.

II. Toner for Developing Electrostatic Images

The toner for developing electrostatic images according to the present disclosure is a toner for developing electrostatic images, comprising colored resin particles containing a binder resin, a colorant and a wax, wherein, as the wax, the toner contains the above-mentioned wax for toners for developing electrostatic images.

Hereinafter, a method for producing colored resin particles used in the present disclosure, the colored resin particles obtained by the production method, a method for producing a toner using the colored resin particles, and the toner of the present disclosure will be described in this order.

1. Method for Producing Colored Resin Particles

In general, methods for producing colored resin particles are broadly classified into dry methods such as a pulverization method and wet methods such as an emulsion polymerization agglomeration method, a suspension polymerization method and a solution suspension method. The wet methods are preferable since a toner having excellent printing characteristics such as image reproducibility, can be easily obtained. Among the wet methods, polymerization methods such as the emulsion polymerization agglomeration method and the suspension polymerization method are preferable, since a toner having a relatively small particle size distribution in micron order can be easily obtained. Among the polymerization methods, the suspension polymerization method is more preferable.

The emulsion polymerization agglomeration method is a method for producing colored resin particles by polymerizing emulsified polymerizable monomers to obtain a resin microparticle emulsion, and aggregating the resulting resin microparticles with a colorant dispersion, etc. The solution suspension method is a method for producing colored resin particles by forming a solution into droplets in an aqueous medium, the solution containing toner components such as a binder resin and a colorant dissolved or dispersed in an organic solvent, and removing the organic solvent. Both methods can be carried out by known methods.

The colored resin particles used in the present disclosure can be produced by the wet methods or the dry methods. The wet methods are preferable, and the suspension polymerization method is especially preferable among the wet methods. When the suspension polymerization method is employed, the colored resin particles may be produced by the following steps.

(A) Suspension Polymerization Method (A-1) Preparation Step of Polymerizable Monomer Composition First, a polymerizable monomer, a colorant, a wax, and, as needed, other additives such as a charge control agent and a molecular weight modifier, are mixed to prepare a polymerizable monomer composition. For example, a media type dispersing machine is used for the mixing in the preparation of the polymerizable monomer composition.

In the present disclosure, the polymerizable monomer means a monomer having a polymerizable functional group, and a binder resin is made by polymerization of the polymerizable monomer. It is preferable to use a monovinyl monomer as a main component of the polymerizable monomer. Examples of the monovinyl monomer include styrene; styrene derivatives such as vinyltoluene and α-methylstyrene; acrylic acid and methacrylic acid; acrylic acid esters such as methyl acrylate, ethyl acrylate, propyl acrylate, butyl acrylate, 2-ethylhexyl acrylate and dimethylaminoethyl acrylate; methacrylic acid esters such as methyl methacrylate, ethyl methacrylate, propyl methacrylate, butyl methacrylate, 2-ethylhexyl methacrylate and dimethylaminoethyl methacrylate; nitrile compounds such as acrylonitrile and methacrylonitrile; amide compounds such as acrylamide and methacrylamide; and olefins such as ethylene, propylene and butylene. These monovinyl monomers may be used solely or in combination of two or more kinds. Among them, styrene, the styrene derivative, or the derivative of acrylic acid or methacrylic acid is preferably used as the monovinyl monomer; at least one selected from the group consisting of styrene, the styrene derivatives, the acrylic esters and the methacrylic esters is more preferably used as the monovinyl monomer; and a combination of at least one selected from the group consisting of styrene and the styrene derivatives and at least one selected from the group consisting of the acrylic esters and the methacrylic esters, is even more preferably used as the monovinyl monomer.

In the present disclosure, the monovinyl monomer is used in an amount of generally 80 parts by mass or more, preferably 90 parts by mass or more, and more preferably 95 parts by mass or more, with respect to 100 parts by mass of the total mass of the polymerizable monomer.

In the present disclosure, with respect to 100 parts by mass of the monovinyl monomer, the total content of styrene and styrene derivative is preferably from 50 parts by mass to 90 parts by mass, and the total content of acrylic ester and methacrylic ester is preferably from 10 parts by mass to 50 parts by mass.

To improve hot offset and shelf stability, it is preferable to use any crosslinkable polymerizable monomer in combination with the monovinyl monomer. The crosslinkable polymerizable monomer means a monomer having two or more polymerizable functional groups. Examples of the crosslinkable polymerizable monomer include: aromatic divinyl compounds such as divinyl benzene, divinyl naphthalene and derivatives thereof; ester compounds such as ethylene glycol dimethacrylate and diethylene glycol dimethacrylate, in which two or more carboxylic acids are esterified to an alcohol having two or more hydroxyl groups; other divinyl compounds such as N,N-divinylaniline and divinyl ether; and compounds having three or more vinyl groups. These crosslinkable polymerizable monomers can be used solely or in combination of two or more kinds. Among them, aromatic divinyl compounds are preferably used as the crosslinkable polymerizable monomer, and more preferably at least one selected from the group consisting of divinyl benzene, divinyl naphthalene and derivatives thereof is used.

In the present disclosure, the crosslinkable polymerizable monomer is used in an amount of generally from 0.1 to 5 parts by mass, preferably from 0.3 to 2 parts by mass, and more preferably from 0.3 to 0.5 parts by mass, with respect to 100 parts by mass of the monovinyl monomer.

Further, the use of a macromonomer as a part of the polymerizable monomer gives rise to a good balance between the shelf stability and low-temperature fixability of the toner. The macromonomer has a polymerizable carbon-carbon unsaturated double bond at the end of the molecular chain and is a reactive oligomer or polymer which usually has a number average molecular weight of from 1,000 to 30,000. It is preferable that the macromonomer can form a polymer having a glass transition temperature (hereinafter sometimes referred as "Tg") higher than that of a polymer obtained by polymerizing a monovinyl monomer. The macromonomer is used in an amount of preferably from 0.03 to 5 parts by mass, and more preferably from 0.05 to 1 part by mass, with respect to 100 parts by mass of the monovinyl monomer.

In the present disclosure, a colorant is used. To produce a color toner, a black colorant, a cyan colorant, a yellow colorant and a magenta colorant can be used.

Examples of the black colorant to be used include carbon black, titanium black and magnetic powder such as zinc-iron oxide and nickel-iron oxide.

Examples of the cyan colorant to be used include dyes and pigments, such as copper phthalocyanine compounds, derivatives thereof and anthraquinone compounds. The specific examples include C.I. Pigment Blue 2, 3, 6, 15, 15:1, 15:2, 15:3, 15:4, 16, 17:1 and 60.

Examples of the yellow colorant to be used include compounds such as azo pigments (e.g., monoazo pigments and disazo pigments), condensed polycyclic pigments and dyes. The specific examples include C.I. Pigment Yellow 3, 12, 13, 14, 15, 17, 62, 65, 73, 74, 83, 93, 97, 120, 138, 155, 180, 181, 185, 186, 213 and 214, and C.I. Solvent Yellow 98.

Examples of the magenta colorant to be used include compounds such as azo pigments (e.g., monoazo pigments and disazo pigments, condensed polycyclic pigments and dyes. The specific examples include C.I. Pigment Red 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209, 237, 238, 251, 254, 255 and 269 and C.I. Pigment Violet 19.

In the present disclosure, these colorants can be used alone or in combination of two or more kinds. The content of the colorant is preferably in the range of from 1 part by mass to 10 parts by mass, with respect to 100 parts by mass of the monovinyl monomer.

The toner of the present disclosure contains the above-mentioned wax for toners for developing electrostatic images as the wax.

The content of the wax for toners for developing electrostatic images is, with respect to 100 parts of the binder resin, preferably from 5 parts by mass to 30 parts by mass, more preferably from 8 parts by mass to 25 parts by mass, and even more preferably from 10 parts by mass to 20 parts by mass. Since the content of the wax for toners for developing electrostatic images is from 5 parts by mass to 30 parts by mass, the effects of excellent low-temperature fixability and heat-resistant shelf stability, and the effects of suppressing the generation of ultrafine particles and the bleeding of the wax can be obtained in a more balanced manner.

In the present disclosure, the toner may further contain a hydrocarbon wax as the wax. As the hydrocarbon wax, examples include, but are not limited to, a paraffin wax, a polyethylene wax, a polypropylene wax, a Fischer-Tropsch wax and a microcrystalline wax. By using the hydrocarbon wax in combination with the above-mentioned wax for toners for developing electrostatic images, the balance between the low-temperature fixability and the heat-resistant shelf stability can be further improved; the bleeding of the wax can be more efficiently suppressed; and the lowering of the hot offset resistance can be suppressed.

Among these hydrocarbon waxes, a paraffin wax is more preferable. By using the paraffin wax in combination with the above-mentioned wax for toners for developing electrostatic images, the balance between the low-temperature fixability and the heat-resistant shelf stability can be further improved; the bleeding of the wax can be more efficiently suppressed; and the lowering of the hot offset resistance can be suppressed. As a commercially-available paraffin wax, examples include HNP-10 (: product name, manufactured by: NIPPON SEIRO CO., LTD., the carbon number of the wax molecule contained the most in the wax: 45, melting point: 72° C.) and HNP-11 (: product name, manufactured by: NIPPON SEIRO CO., LTD., the carbon number of the wax molecule contained the most in the wax: 32, melting point: 68° C.).

The hydrocarbon wax may include two or more kinds of wax molecules. The wax molecules contained the most in the wax may have 35 to 55 carbon atoms. The melting point of the hydrocarbon wax may be from 60° C. to 85° C. By using the hydrocarbon wax as characterized above, a decrease in hot offset resistance can be suppressed, and the generation of ultrafine particles can be more efficiently suppressed.

The wax molecules contained the most in the hydrocarbon wax preferably have 36 to 54 carbon atoms, and more preferably 40 to 50 carbon atoms. The melting point of the hydrocarbon wax is preferably from 64° C. to 84° C., and more preferably from 69° C. to 79° C.

As the hydrocarbon wax, examples include the above-mentioned HNP-10 (: product name, manufactured by: NIPPON SEIRO CO., LTD., the carbon number of the wax molecule contained the most in the wax: 45, melting point: 72° C.).

The content of the hydrocarbon wax is preferably from 1 part by mass to 20 parts by mass, more preferably from 3 parts by mass to 15 parts by mass, and even more preferably from 5 parts by mass to 10 parts by mass. Since the content of the hydrocarbon wax is preferably from 1 part by mass to 20 parts by mass, the effects of excellent low-temperature fixability and heat-resistant shelf stability, and the effects of suppressing the generation of ultrafine particles and the bleeding of the wax can be obtained in a more balanced manner.

In the present disclosure, as the wax, a mixed crystal of the above-mentioned wax for toners for developing electrostatic images and the hydrocarbon wax is preferably used, and a mixed crystal of the above-mentioned wax for toners for developing electrostatic images and the paraffin wax is more preferably used.

By using the mixed crystal of the wax for toners for developing electrostatic images and the hydrocarbon wax, the wax obtains an appropriate dispersion diameter in the toner. Accordingly, the suppression of the bleeding during the toner storage and an improvement of exudation from the fixed toner can be achieved. As a result, both excellent low-temperature fixability and excellent glossiness can be achieved.

As the mixed crystal of the wax for toners for developing electrostatic images and the hydrocarbon wax, a commercially-available product may be used, or a product obtained by a known method may be used.

An example of the method for producing the mixed crystal of the wax for toners for developing electrostatic images and the hydrocarbon wax described above, is as follows.

The above-described wax for toners for developing electrostatic images and the hydrocarbon wax are added to a reaction vessel equipped with a thermometer, a nitrogen introduction pipe, a stirring blade and a cooling pipe. By adjusting the mixing ratio of the waxes, the ratio of the waxes in the obtained mixed crystal can be adjusted. The mixture is heated and melted under a nitrogen atmosphere, heated and stirred so as to be uniform, and then cooled down, thereby obtaining the mixed crystal of the wax for toners for developing electrostatic images and the hydrocarbon wax.

In the present disclosure, other waxes may also be used in combination with the wax for toners for developing electrostatic images (and preferably the hydrocarbon wax). Examples of the other waxes include, but are not limited to, low molecular weight polyolefin waxes and modified waxes thereof; plant-based natural waxes such as jojoba; mineral-based waxes such as ozokerite.

The content of the wax is preferably from 5 parts by mass to 30 parts by mass, more preferably from 6 parts by mass to 28 parts by mass, even more preferably from 8 parts by mass to 25 parts by mass, and still more preferably from 10 parts by mass to 25 parts by mass. In the present disclosure, the content of the wax means the total content of waxes when two or more waxes are used in combination.

When the content of the wax is from 5 parts by mass to 30 parts by mass, the effects of excellent low-temperature fixability and heat-resistant shelf stability, and the effects of suppressing the generation of ultrafine particles and the bleeding of the wax can be obtained in a more balanced manner.

In the present disclosure, a charge control agent is used to improve the chargeability of the toner.

The charge control agent is not particularly limited, as long as it is one that is generally used as a charge control agent for toner. Among charge control agents, a positively- or negatively-chargeable charge control resin is preferable, from the point of view that the charge control resin is highly compatible with the polymerizable monomer and can impart stable chargeability (charge stability) to the toner particles, and from the viewpoint of improving the dispersibility of the colorant used in the present disclosure. From the viewpoint of obtaining a negatively-chargeable toner, the negatively-chargeable charge control resin is more preferably used.

As the positively-chargeable charge control agent, examples include a nigrosine dye, a quaternary ammonium salt, a triaminotriphenylmethane compound, an imidazole compound, and a charge control resin such as a polyamine resin, a quaternary ammonium group-containing copolymer and a quaternary ammonium salt group-containing copolymer. Among them, the charge control resin is preferable.

As the negatively-chargeable charge control agent, examples include an azo dye containing a metal such as Cr, Co, Al and Fe, a salicylic acid metal compound, an alkyl salicylic acid metal compound, and a charge control resin such as a sulfonic acid group-containing copolymer, a sulfonic acid salt group-containing copolymer, a carboxylic acid group-containing copolymer and a carboxylic acid salt group-containing copolymer. Among them, the charge control resin is preferable.

The weight average molecular weight (Mw) of the charge control resin is a polystyrene equivalent molecular weight measured by gel permeation chromatography (GPC) using tetrahydrofuran. It is preferably in a range of from 5,000 to 30,000, more preferably in a range of from 8,000 to 25,000, and still more preferably in a range of from 10,000 to 20,000.

The copolymerization ratio of a monomer having a functional group such as a quaternary ammonium group or a sulfonate group in the charge control resin, is in the range of from 0.5% by mass to 12% by mass, preferably in the range of from 1.0% by mass to 6% by mass, and more preferably in the range of from 1.5% by mass to 3% by mass.

In the present disclosure, the charge control agent is used in an amount of generally from 0.01 parts by mass to 10 parts by mass, and preferably from 0.03 parts by mass to 8 parts by mass, with respect to 100 parts by mass of the monovinyl monomer. When the added amount of the charge control agent is less than 0.01 parts by mass, fog may occur. On the other hand, when the added amount of the charge control agent is more than 10 parts by mass, printing soiling may occur.

It is preferable to use a molecular weight modifier as another additive, when the polymerizable monomer is polymerized to obtain the binder resin.

The molecular weight modifier is not particularly limited, as long as it is one that is generally used as a molecular weight modifier for toners. As the molecular weight modifier, examples include, but are not limited to, mercaptans such as t-dodecyl mercaptan, n-dodecyl mercaptan, n-octyl mercaptan and 2,2,4,6,6-pentamethylheptane-4-thiol, and thiuram disulfides such as tetramethyl thiuram disulfide, tetraethyl thiuram disulfide, tetrabutyl thiuram disulfide, N,N'-dimethyl-N,N'-diphenyl thiuram disulfide and N,N'-dioctadecyl-N,N'-diisopropyl thiuram disulfide. These molecular weight modifiers may be used solely or in combination of two or more kinds.

In the present disclosure, the molecular weight modifier is used in an amount of generally from 0.01 parts by mass to 10 parts by mass, and preferably from 0.1 parts by mass to 5 parts by mass, with respect to 100 parts by mass of the monovinyl monomer.

(A-2) Suspension Step to Obtain Suspension (Droplets Forming Step)

In the present disclosure, the polymerizable monomer composition containing the polymerizable monomer and the magenta colorant is dispersed in an aqueous medium containing a dispersion stabilizer; a polymerization initiator is added therein; then, the polymerizable monomer composition is formed into droplets. The method for forming the droplets is not particularly limited. The droplets are formed, for example, by means of a device capable of strong stirring, such as an in-line type emulsifying and dispersing machine (product name: MILDER; manufactured by Pacific Machinery & Engineering Co., Ltd.) and a high-speed emulsification dispersing machine (product name: T. K. HOMOMIXER MARK II; manufactured by PRIMIX Corporation).

As the polymerization initiator, examples include persulfates such as potassium persulfate and ammonium persulfate; azo compounds such as 4,4'-azobis(4-cyanovaleric acid), 2,2'-azobis(2-methyl-N-(2-hydroxyethyl)propionamide), 2,2'-azobis(2-amidinopropane)dihydrcochloride, 2,2'-azobis(2,4-dimethylvaleronitrile) and 2,2'-azobisisobutyronitrile; and organic peroxides such as di-t-butylperoxide, benzoylperoxide, t-butylperoxy-2-ethylhexanoate, t-butylperoxy-2-ethylbutanoate, t-hexylperoxy-2-ethylbutanoate, diisopropylperoxydicarbonate, di-t-butylperoxyisophthalate and t-butylperoxyisobutyrate. They can be used solely or in combination of two or more kinds. Among them, the organic peroxides are preferably used since they can reduce a residual polymerizable monomer and can impart excellent printing durability.

Among the organic peroxides, preferred are peroxy esters, and more preferred are non-aromatic peroxy esters (i.e., peroxy esters having no aromatic ring), since they have good initiator efficiency and can reduce a residual polymerizable monomer.

The polymerization initiator may be added after dispersing the polymerizable monomer composition in the aqueous medium and before forming the droplets as described above, or it may be added to the polymerizable monomer composition before dispersing the polymerizable monomer composition in the aqueous medium.

The added amount of the polymerization initiator used in the polymerization reaction of the polymerizable monomer composition, is preferably from 0.1 parts by mass to 20 parts by mass, more preferably from 0.3 parts by mass to 15 parts by mass, and still more preferably from 1 part by mass to 10 parts by mass, with respect to 100 parts by mass of the monovinyl monomer.

In the present disclosure, the aqueous medium means a medium containing water as a main component.

In the present disclosure, the dispersion stabilizer is preferably added to the aqueous medium. As the dispersion stabilizer, examples include the following inorganic and organic compounds: inorganic compounds including sulfates such as barium sulfate and calcium sulfate, carbonates such as barium carbonate, calcium carbonate and magnesium carbonate, phosphates such as calcium phosphate, metal oxides such as aluminum oxide and titanium oxide, and metal hydroxides such as aluminum hydroxide, magnesium hydroxide and iron(II) hydroxide, and organic compounds including water-soluble polymers such as polyvinyl alcohol, methyl cellulose and gelatin; anionic surfactants, nonionic surfactants, and ampholytic surfactants. These dispersion stabilizers can be used solely or in combination of two or more kinds. The added amount of the dispersion stabilizer is preferably from 0.1 to 20 parts by mass, and more preferably from 0.2 to 10 parts by mass, with respect to 100 parts by mass of the polymerizable monomer.

Among the above dispersion stabilizers, the inorganic compounds are preferable. As the aqueous medium containing the dispersion stabilizer, a colloid of a hardly water-soluble metal hydroxide is particularly preferable. The use of the inorganic compounds, particularly the use of the colloid of the hardly water-soluble metal hydroxide, can narrow the particle size distribution of the colored resin particles and can reduce the amount of the dispersion stabilizer remaining after washing. Accordingly, the polymerized toner thus obtained becomes capable of reproducing clear images and inhibiting a deterioration in environmental stability.

(A-3) Polymerization Step

After the polymerizable monomer composition droplets are formed as described in the above (A-2), the polymerizable monomer composition is subjected to polymerization reaction in the presence of a polymerization initiator, whereby colored resin particles are formed. That is, the aqueous dispersion medium in which the polymerizable monomer composition are dispersed, is heated to start polymerization, whereby an aqueous dispersion of the colored resin particles containing the binder resin, the colorant and the wax is formed.

The polymerization temperature of the polymerizable monomer composition is preferably 50° C. or more, and more preferably from 60° C. to 95° C. The polymerization reaction time is preferably from 1 to 20 hours, and more preferably from 2 to 15 hours.

To carry out the polymerization in the state that the droplets of the polymerizable monomer composition are stably dispersed, in this polymerization process, the polymerization reaction may be further promoted following the above "(A-2) Suspension Step to Obtain Suspension (Droplets Forming Step)", with carrying out the dispersion treatment by agitation.

The colored resin particles may be used as the toner as they are or in the form of a mixture with an external additive. It is preferable to use the above-mentioned colored resin particles as the core layer of so-called core-shell type (or "capsule type") colored resin particles. The core-shell type colored resin particles have a structure such that the outside of the core layer is covered with a shell layer that is made of a different substance from the core layer. The core layer is made of a substance having a low softening point, and by covering the core layer with a substance having a higher softening point, the toner can take a balance of lowering the fixing temperature of the toner and prevention of toner aggregation during storage.

The method for producing the above-mentioned core-shell type colored resin particles by using the above-mentioned colored resin particles, is not particularly limited, and they can be produced by any conventional method. The in situ polymerization method and the phase separation method are preferable from the viewpoint of production efficiency.

Hereinafter, the method for producing the core-shell type colored resin particles according to the in situ polymerization method, will be described.

The core-shell type colored resin particles can be obtained by adding a polymerizable monomer for forming a shell layer (a polymerizable monomer for shell) and a polymerization initiator to the aqueous medium in which the colored resin particles are dispersed, and then polymerizing the monomer.

As the polymerizable monomer for shell, the above-mentioned polymerizable monomers can be similarly used. Among the polymerizable monomers, those that can provide a polymer having a Tg of more than 80° C., such as styrene, acrylonitrile and methyl methacrylate, are preferably used solely or in combination of two or more kinds.

As the polymerization initiator used for polymerization of the polymerizable monomer for shell, examples include, but are not limited to, water-soluble polymerization initiators including metal persulfates such as potassium persulfate and ammonium persulfate, and azo-type initiators such as 2,2'-azobis(2-methyl-N-(2-hydroxyethyl) propionamide) and 2,2'-azobis(2-methyl-N-(1,1-bis(hydroxymethyl)-2-hydroxyethyl) propionamide). These polymerization initiators can be used solely or in combination of two or more kinds. The content of the polymerization initiator is preferably from 0.1 parts by mass to 30 parts by mass, and more preferably from 1 part by mass to 20 parts by mass, with respect to 100 parts by mass of the polymerizable monomer for shell.

The polymerization temperature of the shell layer is preferably 50° C. or more, and more preferably from 60° C. to 95° C. The polymerization reaction time is preferably from 1 to 20 hours, and more preferably from 2 to 15 hours.

(A-4) Washing, Filtering, Dehydrating and Drying Steps

It is preferable that after the polymerization, the aqueous dispersion of the colored resin particles obtained by the polymerization is subjected to operations of filtering, washing for removal of the dispersion stabilizer, dehydrating, and drying by several times as needed, according to any conventional method.

The washing step may be carried out by the following method: when the inorganic compound is used as the dispersion stabilizer, it is preferable that the dispersion stabilizer is dissolved in water and removed by adding acid or alkali to the aqueous dispersion of the colored resin particles. When the colloid of the hardly water-soluble inorganic hydroxide is used as the dispersion stabilizer, it is preferable that the pH of the aqueous dispersion of the colored resin particles is adjusted to 6.5 or less by adding acid. As the added acid, examples include inorganic acid such as sulfuric acid, hydrochloric acid and nitric acid, and organic acid such as formic acid and acetic acid. Among them, sulfuric acid is particularly preferable for its high removal efficiency and small impact on production facilities.

The dehydrating and filtering steps may be carried out by any of various known methods, without particular limitation. For example, a centrifugal filtration method, a vacuum filtration method and a pressure filtration method may be used. Also, the drying step may be carried out by any of various methods, without particular limitation.

(B) Pulverization Method

In the case of producing the colored resin particles by employing the pulverization method, the production is carried out by the following steps, for example.

First, a binder resin, a colorant, wax and other additives which are added as needed, such as a charge control agent and a molecular weight modifier, are mixed by means of a mixer such as a ball mill, a V type mixer, FM MIXER (: product name), a high-speed dissolver, an internal mixer and a fallberg.

Next, the thus-obtained mixture is kneaded while heating by means of a press kneader, a twin screw kneading machine, a roller or the like. The thus-obtained kneaded product is coarsely pulverized by means of a pulverizer such as a hammer mill, a cutter mill and a roller mill. The coarsely pulverized product is pulverized by finely pulverizing by means of a pulverizer such as a jet mill and a high-speed rotary pulverizer. Then, the finely pulverized product is classified into desired particle diameters by means of a classifier such as an air classifier and an airflow classifier, thereby obtaining colored resin particles produced by the pulverization method. The obtained kneaded product is coarsely pulverized by means of a pulverizer such as a hammer mill, a cutter mill or a roller mill, finely pulverized by means of a pulverizer such as a jet mill or a high-speed rotary pulverizer, and then classified into a desired particle diameter by means of a classifier such as a wind classifier or an airflow classifier, thereby obtaining the colored resin particles produced by the pulverization method.

As the binder resin, the colorant, the wax, and the other additives added as needed (such as the charge control agent and the molecular weight modifier), those mentioned above in "(A) Suspension Polymerization Method" can be used in the pulverization method. As the colored resin particles obtained by the pulverization method, core-shell type colored resin particles may be produced by the in situ polymerization method, etc., as with the colored resin particles obtained by the above-mentioned "(A) Suspension polymerization method".

As the binder resin, other resins which are conventionally and broadly used for toners can be used. As the binder resin used in the pulverization method, examples also include, but are not limited to, polystyrene, styrene-butyl acrylate copolymers, polyester resins and epoxy resins.

2. Colored Resin Particles

The colored resin particles are obtained by the above production method such as (A) Suspension polymerization method or (B) Pulverization method.

The colored resin particles obtained the above steps will be described (the colored resin particles described below encompass both core-shell type colored resin particles and different types of colored resin particles).

The volume average particle diameter (Dv) of the colored resin particles is preferably from 3 μm to 10 μm, and more preferably from 5.2 μm to 7.2 μm. When the volume average particle diameter (Dv) of the colored resin particles is from 3 μm to 10 μm, a decrease in a flowability of the toner, a deterioration in transferability, a decrease in image density and a decrease in a resolution of an image are not likely to occur.

As for the colored resin particles, particle diameter distribution, which is the ratio (Dv/Dp) between the volume average particle diameter (Dv) and the number average particle diameter (Dp) is preferably from 1.00 to 1.30, more preferably from 1.05 to 1.20, and even more preferably from 1.10 to 1.16. When "Dv/Dp" is from 1.00 to 1.30, a decrease in transferability, image density or resolution is not likely to occur. The volume average particle diameter and the number average particle diameter of the colored resin particles can be measured by means of a particle diameter distribution measuring device (product name: MULTISIZER; manufactured by Beckman Coulter, Inc.), for example.

The average circularity of the colored resin particles of the present disclosure is in a range of preferably from 0.960 to 1.000, more preferably from 0.970 to 0.995, and even more preferably from 0.980 to 0.990, from the viewpoint of the image reproducibility.

When the average circularity of the colored resin particles is less than 0.960, a deterioration in thin line reproducibility in printing may occur.

3. Toner of the Present Disclosure

As the toner of the present disclosure, the above-mentioned colored resin particles can be used as they are, or the mixture of the above-mentioned colored resin particles and carrier particles such as ferrite, iron powder or the like can be used. From the viewpoint of controlling the chargeability, flowability and shelf stability of the toner, the colored resin particles may be used as a one-component toner by mixing the colored resin particles with the external additives to add the external additives on the surface of the colored resin particles. The one-component toner may be further mixed and stirred together with carrier particles to make a two-component toner.

A mixer is used to add the external additive on the particle surface. The mixer is not particularly limited, as long as it is a mixer capable of add the external additive on the surface of the colored resin particles. For example, the external additive can be added by means of a mixing machine capable of mixing and stirring, such as FM MIXER (: product name, manufactured by NIPPON COKE & ENGINEERING CO., LTD.), SUPER MIXER (: product name, manufactured by KAWATA Manufacturing Co., Ltd.), Q MIXER (: product name, manufactured by NIPPON COKE & ENGINEERING CO., LTD.), MECHANOFUSION SYSTEM (: product name, manufactured by Hosokawa Micron Corporation) and MECHANOMILL (: product name, manufactured by Okada Seiko Co., Ltd.)

As the external additive, examples include, but are not limited to, inorganic fine particles such as fine particles of silica, titanium oxide, aluminum oxide, zinc oxide, tin oxide, calcium carbonate, calcium phosphate and cerium oxide, and organic fine particles such as fine particles of polymethyl methacrylate resin, silicone resin and melamine resin. Among them, the inorganic fine particles are preferable. Among the inorganic fine particles, fine particles of at least one selected from silica and titanium oxide are preferable, and fine particles of silica are particularly preferable.

These external additives may be used solely. It is preferable to use them in combination of two or more kinds.

In the present disclosure, the external additive is used in an amount of generally from 0.05 parts by mass to 6 parts by mass, and preferably from 0.2 parts by mass to 5 parts by mass, with respect to 100 parts by mass of the colored resin particles. When the added amount of the external additive is less than 0.05 parts by mass, a transfer residue may be generated. When the added amount of the external additive is more than 6 parts by mass, fog may occur.

Since the toner of the present disclosure obtained through the above-described steps contains the wax for the toner for developing electrostatic images as a wax, the toner is excellent in low-temperature fixability and heat-resistant shelf stability, and the generation ultrafine particles and bleeding of the wax are not likely to occur.

The ½ outflow temperature $T_{1/2}$ of the toner of the present disclosure measured by a flow tester, may be from 125° C. to 135° C. Since the ½ outflow temperature $T_{1/2}$ is within the range, the balance between the heat-resistant shelf stability and the low-temperature fixability can be further improved.

The ½ outflow temperature $T_{1/2}$ of the toner of the present disclosure measured by the flow tester is preferably from 126° C. to 134° C., and more preferably from 127° C. to 133° C.

The ½ outflow temperature $T_{1/2}$ of the toner measured by the flow tester can be calculated from a melt viscosity measured using the flow tester. In particular, first, the melt viscosity is measured using a flow tester (manufactured by: Shimadzu Corporation, product name: CFT-500C or the like) under the conditions of a predetermined starting temperature, a predetermined temperature rising rate, a predetermined preheating period and a predetermined shearing stress. From the obtained melt viscosity, the ½ outflow temperature $T_{1/2}$ of the toner can be determined.

The ½ outflow temperature $T_{1/2}$ can be adjusted by the addition amount of the crosslinkable monomer, for example.

The dissipation start temperature of the toner of the present disclosure is preferably 205° C. or higher. In the present disclosure, the "dissipation start temperature" means a temperature at which ultrafine particles start to dissipate from the toner.

In general, a low molecular weight component is released from the toner heated for fixing. By aggregation and liquefaction of the low molecular weight component in the atmosphere, ultrafine particles (UFPs) are dissipated. Therefore, it can be said that the higher the dissipation start temperature is, the more difficult it is to dissipate the ultrafine particles from the toner.

The dissipation start temperature is determined by the following CPC (Condensation Particle Counter) measurement.

First, a predetermined amount of the toner is heated on a heater installed in a chamber. The ultrafine particles discharged into the chamber are continuously measured by a fine particle measuring instrument (for example, model: CPC3007, manufactured by: TSI Inc.) The temperature of the heater is then raised from 180° C., and the total count number of ultrafine particles which have a particle diameter of from 10 nm to 1000 nm and which are observed during the measurement, is read in increments of 5° C. The temperature at which the total count number exceeds 10,000, is defined as the dissipation start temperature of the toner.

The bleeding rate of the toner of the present disclosure is preferably 5% or less, more preferably 1% or less, and even more preferably 0%. In the present disclosure, the "bleeding rate" means a rate at which the wax is detached (bleeds) from the toner.

The bleeding rate is measured by the following storage test.

The toner is stored for 20 days in an environment at a temperature of 45° C. and a humidity of 80%. Then, the toner is observed by SEM. Ten images of the toner are taken at a magnification of 2,000 times. Next, for each toner image, the number (A) of all toner particles in the image and the number (B) of wax-bleeding toner particles in the image are counted. Then, for each toner image, the number (B) of the toner particles is divided by the number (A) of the toner particles, and the resulting value is multiplied by 100 to calculate a value. The average of the values calculated for the ten images of the toner is defined as the bleeding rate (%) of the toner.

EXAMPLES

Hereinafter, the present disclosure will be described further in detail, with reference to examples and comparative examples. However, the present disclosure is not limited to these examples. Herein, "part(s)" and "%" are on a mass basis unless otherwise noted.

Test methods carried out in the examples and the comparative examples are as follows.

1. Production of Wax for Toners for Developing Electrostatic Images

Example A

Hereinafter, a method for producing a wax a1 will be described. The mass ratio of the raw material monocarboxylic acid of the wax a1 is shown in Table 1 below.

First, 10 parts of pentaerythritol, 72.2 parts of behenic acid, 9.2 parts of arachidic acid and 18.6 parts of stearic acid (1.05 molar equivalents of pentaerythritol in total) were added to a reaction vessel equipped with a thermometer, a nitrogen introduction tube, a stirrer, a Dean-Stark trap and a gymrot cooling tube. Then, they were reacted at 220° C. under a nitrogen flow for 20 hours, while water produced by the reaction was distilled off, thereby obtaining an esterified crude product. To the esterified crude product, 10 parts of toluene and 5 parts of isopropanol were added, and 15 parts of 10% aqueous potassium hydroxide solution in an amount corresponding to 1.5 times the acid value of the esterified crude product, was added. Then, the mixture was stirred at 70° C. for 30 minutes. The mixture was allowed to stand for 30 minutes; an aqueous phase portion thus formed was removed therefrom; and the deoxidation step was completed. Then, 20 parts of ion-exchanged water was added to an oil phase portion thus obtained, and the mixture was stirred at 70° C. for 30 minutes and then allowed to stand for 30 minutes. An aqueous phase portion thus formed was removed therefrom. Water washing was repeated four times until the pH of the removed aqueous phase portion became neutral. The oil phase portion after washing with water was distilled off under reduced pressure at 180° C. and 1 kPa, followed by filtration, thereby obtaining the wax a1 as a final target product.

Example B

Hereinafter, the process for producing a mixed crystal wax A1 will be described, in which the wax a1 and a wax b1 (paraffin wax, product name: HNP-10, manufactured by: NIPPON SEIRO CO., LTD., the carbon number of the wax molecule contained the most in the wax: 45, melting point: 72° C.) were used.

First, 75.0 g of the wax a1 and 25.0 g of the wax b1 were added to a reaction vessel equipped with a thermometer, a nitrogen introduction tube, a stirring blade and a cooling tube. Then, the obtained mixture was heated and melted under a nitrogen atmosphere at 100° C., heated and stirred for 30 minutes so as to be uniform, and then cooled down, thereby obtaining the mixed crystal wax A1 as a final target product.

Examples C and D

A wax a2 and a wax a3 were obtained in the same manner as in Example A, except that the amounts of the behenic acid, the arachidic acid and the stearic acid were changed as shown below in Table 1.

Comparative Example A

A mixed crystal wax X was produced in the same manner as in Example B, except that 75.0 g of a wax x (pentaerythritol tetrastearate, melting point: 76.0° C., melt viscosity: 5.5 mPa/s at 130° C.) was used instead of 75.0 g of the wax a1, and 25.0 g of a wax b2 (paraffin wax, product name: HNP-11, manufactured by: NIPPON SEIRO CO., LTD., the carbon number of the wax molecule contained the most in the wax: 32, melting point: 68° C.) was used instead of 25.0 g of the wax b1. The mass ratio of the raw material monocarboxylic acid of the wax x is shown in Table 1 below.

2. Production of Toners

Example 1

First, 75 parts of styrene and 25 parts of n-butyl acrylate as monovinyl monomers, 0.35 parts of divinylbenzene as a crosslinkable polymerizable monomer, 12 parts of carbon black (product name: #25B; manufactured by: Mitsubishi Chemical Corporation) as a black colorant, 5.0 parts of a positively-chargeable charge control resin (product name: FCA-676P, manufactured by: Fujikura Kasei Co., Ltd., a quaternary ammonium salt group-containing a styrene acrylic resin), 1.0 part of t-dodecyl mercaptan as a molecular weight modifier, 0.1 parts of a polymethacrylic acid ester macromonomer (product name: AA6; manufactured by: TOAGOSEI Co., Ltd.; Tg: 94° C.) as a macromonomer, and 20 parts of the mixed crystal wax A1 obtained in Example B (the mixed crystal wax containing 15 parts of the wax a1 as an ester wax and 5 parts of the wax b1 as a hydrocarbon wax) were stirred and mixed by a mixer, and then dispersed uniformly, thereby obtaining a polymerizable monomer composition.

An aqueous solution in which 7.0 parts of sodium hydroxide (alkali metal hydroxide) was dissolved in 50 parts of ion exchanged water, was gradually added at room temperature under stirring to an aqueous solution in which 9.0 parts of magnesium chloride (water-soluble polyvalent metal salt) was dissolved in 250 parts of ion exchanged water, whereby a magnesium hydroxide colloid (a poorly water-soluble metal hydroxide colloid) was prepared.

The polymerizable monomer composition was added to the magnesium hydroxide colloidal dispersion, and the mixture was further stirred. Then, as a polymerization initiator, 4.4 parts of t-butylperoxy-2-ethyl hexanoate (product name: TORIGONOX27, manufactured by: Kayaku-AKZO-Corporation) was added thereto. The dispersion mixed with the polymerization initiator was dispersed by high-speed shear agitation at a rotational frequency of 12,000 rpm using a high-speed emulsifying disperser (manufactured by PRIMIX Corporation; product name: T.K. HOMOMIXER MARK II Type) to form the polymerizable monomer composition into droplets.

Next, the aqueous dispersion medium in which the droplets of the polymerizable monomer composition were dispersed, was placed in a reactor from the top, and the temperature of the container was raised to 89° C. to initiate a polymerization reaction. When the polymerization conversion rate reached 95%, 1 part of methyl methacrylate as a polymerizable monomer for shell and 0.3 parts of 2,2'-azobis (2-methyl-N-(2-hydroxyethyl)-propionamide) (product name: VA-086, manufactured by: Wako Pure Chemical Industries, Ltd.; water-soluble) as a polymerization initiator for shell, which was dissolved in 10 parts of ion-exchanged water, were added into the reactor. The reaction was continued for 3 hours at the temperature 90° C. Then, the reactor was water-cooled to stop the reaction to obtain an aqueous dispersion of colored resin particles. The amounts of the monomer units constituting the binder resin contained in the colored resin particles were substantially the same as the charged amounts thereof (the same applies to Examples 2 to 7 and Comparative Examples 1 to 5 described later).

The aqueous dispersion of the colored resin particles was subjected to acid washing in the following manner: while the aqueous dispersion was stirred, sulfuric acid was added thereto in a dropwise manner, until the pH of the aqueous dispersion reached 6.5 or less. Next, water was separated from the aqueous dispersion by filtration, and the thus-obtained solid was re-slurried with 500 parts of ion-exchanged water, and a water washing treatment (washing, filtration and dehydration) at room temperature (25° C.) was carried out thereon several times. The thus-obtained solid was filtered and separated, then was placed in the container of a vacuum dryer, and vacuum dried at 30 torr and a temperature of 50° C. for 72 hours, thereby obtaining dried colored resin particles (average circularity: 0.986).

To 100 parts of the thus-obtained colored resin particles, 0.5 parts of hydrophobized silica fine particles having an average particle diameter of 7 nm, and 1.2 parts of hydrophobized silica fine particles having a BET specific surface area of 50 $m^2/g$ were added. They were mixed by means of a high-speed mixing machine (manufactured by NIPPON COKE & ENGINEERING CO., LTD., product name: FM MIXER) to prepare a toner for developing electrostatic images of Example 1. The following measurements and evaluations were carried out on the obtained toner for developing electrostatic images, according to the following methods. The results are shown in Table 2.

Examples 2 to 5

The toners of Examples 2 to 5 were obtained and tested in the same manner as in Example 1, except the following: the wax a1 obtained in Example A was used instead of the mixed crystal wax A1 obtained in Example B; the addition amount of the wax a1 was as shown below in Table 2; and among the toner composition, the addition amounts of styrene, n-butyl acrylate and divinylbenzene were changed as shown in Table 2 below.

Examples 6 and 7

The toners of Examples 6 and 7 were obtained and tested in the same manner as in Example 1, except that the wax a2 obtained in Example C or the wax a3 obtained in Example D was used instead of the mixed crystal wax A1 obtained in Example B, and among the toner composition, the addition amounts of styrene, n-butyl acrylate and divinylbenzene were changed as shown in Table 2 below.

Comparative Example 1

The toner of Comparative Example 1 was obtained and tested in the same manner as in Example 1, except that the mixed crystal wax X obtained in Comparative Example A was used instead of the mixed crystal wax A1 obtained in Example B, and the addition amount of the mixed crystal wax X was as shown in Table 2 below.

Comparative Examples 2 to 5

The toners of Comparative Examples 2 to 5 were obtained and tested in the same manner as in Example 1, except the following: the wax x or a wax y (pentaerythritol tetrabehenate, melting point: 78.7° C., melt viscosity at 130° C.: 9.3 m·Pa/s) was used instead of the mixed crystal wax A1 obtained in Example B; the addition amount of the wax was as shown in Table 2 below; and among the toner composition, the addition amounts of styrene, n-butyl acrylate and divinylbenzene were changed as shown in Table 2 below. The mass ratio of the raw material monocarboxylic acid of the wax y is shown in Table 1 below.

3. Measurement of Physical Properties of Toners, Etc.

The physical properties of the toners of Examples 1 to 7 and Comparative Examples 1 to 5 were examined. Also, the properties of the colored resin particles used in the toners were examined. The details are as follows.

(1) Measurement of Volume Average Particle Diameter (Dv) and Number Average Particle Diameter (Dp), and Calculation of Particle Size Distribution (Dv/Dp)

About 0.1 g of the colored resin particles were weighed out and put in a beaker. Next, as a dispersant, 0.1 mL of a surfactant aqueous solution (product name: DRIWEL, manufactured by: Fujifilm Corporation) was added thereto. In addition, 10 mL to 30 mL of a dedicated electrolyte (product name: ISOTON II-PC, manufactured by: Beckman Coulter, Inc.) was put in the beaker. The mixture was dispersed for 3 minutes with a 20 W (watt) ultrasonic disperser. Then, the volume average particle diameter (Dv) and number average particle diameter (Dp) of the colored resin particles were measured with a particle size analyzer (product name: MULTISIZER, manufactured by: Beckman Coulter, Inc.) in the following condition: aperture diameter: 100 μm, medium: ISOTON II, and the number of measured particles: 100,000 particles. Then, the particle size distribution (Dv/Dp) of the colored resin particles was calculated. The results of the measurement and calculation are shown in Table 2 below.

(2) Measurement of Blow-Off Charge Amount

First, 9.5 g of a carrier (product name: NZ-3, manufactured by Powdertech Co., Ltd.) and 0.5 g of the toner were weighed out and placed in a glass container with a volume of 100 cc. The glass container was rotated at 150 rpm for 30 minutes. Next, the blow-off charge amount (μQ/g) of the toner was measured by blowing nitrogen gas at a pressure of 4.5 kPa and aspirating the gas at a pressure of 9.5 kPa using a blow-off meter (product name: TB-203, manufactured by: KYOCERA Chemical Corporation). The measurement was carried out at a temperature of 23° C. and a relative humidity of 50%.

(3) Measurement by Flow Tester

The softening temperature $T_s$, the flow initiation temperature $T_{fb}$, the ½ outflow temperature $T_{1/2}$ and the flow termination temperature $T_{end}$ of the toner were measured by the following method.

First, the toner was measured using a flow tester (manufactured by: Shimadzu Corporation, product name: CFT-500C) under the following condition.

Starting temperature: 35° C., heating rate: 3° C./min, preheat duration: 5 min, cylinder pressure: 10.0 kgf/cm$^2$, die diameter: 0.5 mm, die length: 1.0 mm, shearing stress: $2.451\times10^5$ Pa, and sample input: 1.0 g to 1.3 g.

Then, from the measurement results, the softening temperature $T_s$, the flow initiation temperature $T_{fb}$, the ½ outflow temperature $T_{1/2}$ and the flow termination temperature $T_{end}$ of the toner were determined. The ½ outflow temperature $T_{1/2}$ means a temperature at ½ of the stroke change amount from the flow initiation temperature $T_{fb}$ to the flow termination temperature $T_{end}$ when the sample is melted and outflowed under the above condition. The calculation results are shown in Table 2 below.

(4) Shelf Stability of Toner

First, 10 g of the toner was placed in a 100 mL polyethylene container, and the container was hermetically sealed. Then, the container was placed in a constant temperature water bath which was set to a predetermined temperature. After 8 hours passed, the container was removed from the constant temperature water bath. The toner was transferred from the removed container onto a 42-mesh sieve in a manner preventing vibration as much as possible, and then it was set in a powder characteristic tester (manufactured by Hosokawa Micron Corporation, product name: POWDER TESTER PT-R). The amplitude condition of the sieve was set to 1.0 mm, and the sieve was vibrated for 30 seconds. Then, the mass of the toner remaining on the sieve was measured, and the thus-measured mass was determined as an aggregated toner mass.

The maximum temperature at which the aggregated toner mass becomes 0.5 g or less, was used as the index of the shelf stability of the toner.

4 Evaluation of Toners

The toners of Examples 1 to 7 and Comparative Examples 1 to 5 were evaluated. The details are as follows.

(1) Gloss Evaluation

A commercially-available, non-magnetic one-component developing printer was modified so that the temperature of the fixing roller was able to be changed. The toner cartridge in the development device of the modified printer was filled with 100 g of the toner. Then, printing sheets were loaded in the printer.

The printer was adjusted so that the amount of the toner of a solid image on the sheets becomes 0.30 (mg/cm$^2$). Then, the temperature of the fixing roller (fixing temperature) was set at 170° C., and a solid image of 5 cm square was printed on a sheet (manufactured by: Xerox Co., Ltd., product name: VITALITY). The obtained solid image of 5 cm square was measured for gloss value with a gloss meter (product name: VGS-SENSOR, manufactured by: Nippon Denshoku Industries Co., Ltd.) at an incident angle of 60°. The larger the gloss value, the higher the gloss feeling.

(2) Hot Offset Appearance Temperature

A commercially-available, non-magnetic one-component developing printer was modified so that the temperature of the fixing roller was able to be changed. Using the modified printer, a hot offset test was carried out as follows. The temperature of the fixing roller was changed from 150° C. to 220° C. by 5° C., and a solid image of 5 cm square was printed on a sheet (manufactured by: Xerox Co., Ltd., and product name: VITALITY). Then, the existence of the hot offset phenomenon (that is, whether or not the fusion of the toner appeared on the fixing roller) was visually observed.

The lowest temperature at which the fusion of the toner appeared on the fixing roller in the hot offset test, was defined as the hot offset appearance temperature.

(3) Minimum Fixing Temperature

A commercially-available, non-magnetic one-component developing printer was modified so that the temperature of the fixing roller was able to be changed. Using the modified printer, a fixing test was carried out as follows.

A solid black pattern (image density: 100%) was printed. The temperature of the fixing roller of the modified printer was changed by 5° C., and the fixing rate of the toner was measured at each temperature, thereby finding a relationship between the temperature and the fixing rate.

A tape piece was attached to and peeled off from the solid black pattern (image density: 100%), and the fixing rate was calculated as the rate of the image densities before and after the peeling off of the tape piece. Specifically, the fixing rate can be calculated by the following calculation formula where "ID (before)" is the image density before the peeling off of the tape piece, and "ID (after)" is the image density after the peeling off.

Calculation Formula: $\text{Fixing rate (\%)} = (\text{ID(after)}/\text{ID(before)}) \times 100$ The peeling off operation of the tape piece consists of a series of the following operations: a piece of an adhesive tape (product name: SCOTCH MENDING TAPE 810-3-18, manufactured by: Sumitomo 3M Limited) is applied to a measuring area on a test paper sheet; the tape piece is attached to the sheet by pressing the tape piece at a certain pressure; and the attached tape piece is then peeled off at a certain speed in a direction along the paper sheet. The image density was measured by means of a reflection image densitometer (product name: RD914, manufactured by: McBeth Co.)

In this fixing test, the minimum temperature of the fixing roller at which the fixing rate of the toner was more than 80%, was defined as the minimum fixing temperature of the toner.

(4) CPC Measurement

First, 1 g of the toner was heated on a heater installed in a chamber. Ultrafine particles discharged into the chamber were continuously measured by a fine particle measuring instrument (model: CPC3007, manufactured by: TSI Inc.) The temperature of the heater was then raised from 180° C., and the total count number of the ultrafine particles having a particle diameter of from 10 nm to 1000 nm observed during the measurement, was read in increments of 5° C. The temperature at which the total count number exceeded 10,000, was defined as the dissipation start temperature of the toner.

(5) Storage Test

The toner was stored for 20 days in an environment at a temperature of 45° C. and a humidity of 80%. Then, the toner was observed by SEM. Ten images of the toner were taken at a magnification of 2,000 times. Next, for each toner image, the number (A) of all toner particles in the image and the number (B) of wax-bleeding toner particles in the image were counted. Then, for each toner image, the number (B) of the toner particles was divided by the number (A) of the toner particles, and the resulting value was multiplied by 100 to calculate a value. The average of the values calculated for the ten toner images was defined as the bleeding rate (%) of the toner.

Table 2 shows the evaluation results of the toners of Examples 1 to 7 and Comparative Examples 1 to 5, along with the type and addition amounts of the wax in each toner. According to Table 2 below, as described later, Comparative Examples 3 and 4 were found to have a problem with preservability. Accordingly, the CPC measurement and the storage test were not carried out thereon. In Comparative Example 5, since the obtained toner particles were coarsened, a part of the measurements and evaluations were not carried out thereon.

The details of the waxes shown in Table 2 are as follows. In the columns of "Ester wax" and "Hydrocarbon wax" for Example 1 and Comparative Example 1 shown in Table 2, the composition of the waxes contained in the mixed crystal wax A1 and the mixed crystal wax X is shown.

(Ester Wax)

Wax a1: See Example A above (melting point: 75.8° C., melt viscosity at 130° C.: 9.1 mPa/s).

Wax a2: See Example C above (melting point: 73.9° C., melt viscosity at 130° C.: 9.4 mPa/s).

Wax a3: See Example D above (melting point: 76.3° C., melt viscosity at 130° C.: 9.4 mPa/s).

Wax x: Pentaerythritol tetrastearate (Melting point: 76.0° C., melt viscosity at 130° C.: 5.5 mPa/s)

Wax y: Pentaerythritol tetrabehenate (Melting point: 78.7° C., melt viscosity at 130° C.: 9.3 mPa/s)

The mass ratio of the acids in the raw material monocarboxylic acid of each ester wax is shown in Table 1 below.

(Hydrocarbon Wax)

Wax b1: Paraffin wax (product name: HNP-10, manufactured by: NIPPON SEIRO CO., LTD., the carbon number of the wax molecule contained the most in the wax: 45, melting point: 72° C.)

Wax b2: Paraffin wax (product name: HNP-11, manufactured by: NIPPON SEIRO CO., LTD., the carbon number of the wax molecule contained the most in the wax: 32, melting point: 68° C.)

TABLE 1

| Raw material monocarboxylic acid (wt %) | Behenic acid | Arachidic acid | Stearic acid |
|---|---|---|---|
| Wax a1 | 72.2 | 9.2 | 18.6 |
| Wax a2 | 62.4 | 12.8 | 24.8 |
| Wax a3 | 78.5 | 6.3 | 15.2 |
| Wax x | 0 | 0 | 100 |
| Wax y | 100 | 0 | 0 |

TABLE 2

| | | Example 1 | Example 2 | Example 3 | Example 4 | Example 5 | Example 6 | Example 7 |
|---|---|---|---|---|---|---|---|---|
| Mixed crystal wax | Type | Mixed crystal wax A1 | — | — | — | — | — | — |
| | Added amount (parts) | 20 cryst | — | — | — | — | — | — |
| Ester wax | Type | Wax a1 | Wax a1 | Wax a1 | Wax a1 | Wax a1 | Wax a2 | Wax a2 |
| | Melting point (° C.) | 75.8 | 75.9 | 75.8 | 75.8 | 75.8 | 73.3 | 76.3 |
| | Melt viscosity (130° C.) (m · Pa/s) | 9.1 | 9.1 | 9.1 | 9.1 | 9.1 | 8.9 | 9.4 |
| | Added amount (parts) | 15 | 20 | 10 | 20 | 20 | 20 | 20 |
| Hydrocarbon wax | Type | Wax b1 | — | — | — | — | — | — |
| | Melting point (° C.) | 72.0 | — | — | — | — | — | — |
| | Carbon number of the wax molecule contained the most in the wax | 45 | — | — | — | — | — | — |
| | Added amount (parts) | 5 | 0 | 0 | 0 | 0 | 0 | 0 |
| Toner composition | Amount of styrene (parts) | 75 | 73 | 73 | 70 | 77 | 73 | 73 |
| | Amount of n-butyl acrylate (parts) | 25 | 27 | 27 | 30 | 23 | 27 | 27 |
| | Amount of divinyibenzene (parts) | 0.35 | 0.45 | 0.25 | 0.40 | 0.20 | 0.25 | 0.25 |
| Physical properties of toner | Dv (μm) | 5.8 | 5.8 | 5.8 | 6.2 | 6.1 | 6.7 | 7.2 |
| | Dp (μm) | 5.4 | 5.2 | 5.1 | 5.5 | 5.3 | 5.9 | 6.4 |
| | Dv/Dp | 1.07 | 1.12 | 1.14 | 1.13 | 1.15 | 1.14 | 1.13 |
| | Blow-off charge amount (μC/g) | 17.7 | 13.3 | 33.5 | 42.3 | 35.1 | 25.2 | 21.5 |
| | Ts (° C.) | 66 | 66 | 86 | 66 | 66 | 65 | 67 |
| | $T_{fb}$ (° C.) | 102 | 98 | 99 | 100 | 102 | 100 | 103 |
| | $T_{1/2}$ (° C.) | 131 | 128 | 128 | 127 | 133 | 126 | 132 |
| | $T_{end}$ (° C.) | 138 | 135 | 134 | 136 | 140 | 135 | 140 |
| | Shelf stability (° C.) | 58 | 58 | 58 | 54 | 60 | 55 | 57 |
| Printing test | Gloss (170° C.) | 5.0 | 5.2 | 5.7 | 6.2 | 5.1 | 6.4 | 5.4 |
| | Hot offset appearance temperature (° C.) | 210 | 205 | 200 | 200 | 210 | 200 | 215 |
| | Minimum fixing temperature (° C.) | 140 | 145 | 135 | 130 | 150 | 135 | 145 |
| CPC measurement | Dissipation start temperature (° C.) | 205 | 215 | 220 | 210 | 215 | 210 | 220 |
| Storage test | Bleeding rate (%) | 0 | 0 | 0 | 0 | 0 | 0 | 0 |

| | | Comparative Example 1 | Comparative Example 2 | Comparative Example 3 | Comparative Example 4 | Comparative Example 5 |
|---|---|---|---|---|---|---|
| Mixed crystal wax | Type | Mixed crystal wax X | — | — | — | — |
| | Added amount (parts) | 20 | — | — | — | — |
| Ester wax | Type | Wax x | Wax x | Wax x | Wax x | Wax y |
| | Melting point (° C.) | 76.0 | 76.0 | 76.0 | 76.0 | 78.7 |
| | Melt viscosity (130° C.) (m · Pa/s) | 5.5 | 5.5 | 5.5 | 5.5 | 9.3 |
| | Added amount (parts) | 15 | 20 | 20 | 20 | 20 |
| Hydrocarbon wax | Type | Wax b2 | — | — | — | — |
| | Melting point (° C.) | 68 | — | — | — | — |
| | Carbon number of the wax molecule contained the most in the wax | 32 | — | — | — | — |
| | Added amount (parts) | 5 | 0 | 0 | 0 | 0 |
| Toner composition | Amount of styrene (parts) | 75 | 77 | 73 | 70 | 77 |
| | Amount of n-butyl acrylate (parts) | 25 | 23 | 27 | 30 | 23 |
| | Amount of divinyibenzene (parts) | 0.35 | 0.30 | 0.45 | 0.50 | 0 |
| Physical properties of toner | Dv (μm) | 6.5 | 6.8 | 5.1 | 6.0 | —* |
| | Dp (μm) | 5.6 | 5.9 | 4.4 | 5.3 | —* |
| | Dv/Dp | 1.16 | 1.15 | 1.17 | 1.14 | —* |
| | Blow-off charge amount (μC/g) | 47.4 | 15.1 | −13.4 | −4.1 | —* |
| | Ts (° C.) | 64 | 66 | 65 | 62 | 67 |
| | $T_{fb}$ (° C.) | 98 | 101 | 98 | 96 | 101 |
| | $T_{1/2}$ (° C.) | 126 | 129 | 130 | 132 | 131 |
| | $T_{end}$ (° C.) | 133 | 135 | 134 | 133 | 137 |
| | Shelf stability (° C.) | 56 | 57 | 54 | 50 | —* |

TABLE 2-continued

| | | Example 1 | Example 2 | Example 3 | Example 4 | Example 5 | Example 6 | Example 7 |
|---|---|---|---|---|---|---|---|---|
| Printing test | Gloss (170° C.) | 5.0 | 4.6 | 5.8 | 5.3 | —* | | |
| | Hot offset appearance temperature (° C.) | 195 | 215 | >220 | >220 | —* | | |
| | Minimum fixing temperature (° C.) | 135 | 155 | 145 | 135 | —* | | |
| CPC measurement | Dissipation start temperature (° C.) | 180 | 205 | — | — | —* | | |
| Storage test | Bleeding rate (%) | 2.0 | 16.2 | — | — | —* | | |

In the data of Comparative Example 5 shown in Table 1,
"*" indicates that the measurements and evaluations could not be carried out because the obtained toner particles were coarsened.

5. Conclusion

Hereinafter, the evaluation results of the toners will be studied with reference to Table 2.

According to Table 2, the toners of Comparative Examples 1 to 4 are toners containing the wax x as the ester wax. As described below, such toners have variations in toner physical properties and toner evaluation.

When the wax x was used alone and the amount of the styrene in the toner composition was high, the minimum fixing temperature was 155° C. and high, and the bleeding ratio was 16.2% and high (Comparative Example 2). When the wax x was used alone and the amount of the divinylbenzene in the toner composition was high, the evaluation temperature of the heat-resistant shelf stability was 54° C. or less and low (Comparative Examples 3 and 4). Therefore, when pentaerythritol tetrastearate (the wax x) is used alone, the balance between the low-temperature fixability and the heat-resistant shelf stability is insufficient, and the bleeding of the wax is likely to occur. In Comparative Examples 2 to 4, the gloss value is maintained within an appropriate range by adjusting the amount of the crosslinkable monomer and the non-crosslinkable monomer in the toner composition. However, it can be said that the balance between the low-temperature fixability and the heat-resistant shelf stability is collapsed by the use of the wax x.

When the wax x and the wax b2 were used in combination (Comparative Example 1), the hot offset appearance temperature was 195° C. and low, and the dissipation start temperature was 180° C. and low. Therefore, when pentaerythritol tetrastearate (the wax x) is used in combination with other waxes, hot offset is likely to occur, and it is difficult to suppress the generation of ultrafine particles.

When the wax y (pentaerythritol tetrabehenate) was used as the ester wax (Comparative Example 5), the toner particles were coarsened. The reason is considered follows: since the molecular weight of the fatty acid residue portion in the wax y is too large, the solubility (compatibility) of the wax y with respect to the styrene monomer was not sufficient, and as a result, the polymerization reaction hardly proceeded.

According to Table 2, the toners of Examples 1 to 7 are toners containing the wax a1, the wax a2 or the wax a3 as the ester wax, which are waxes produced by the esterification reaction of the pentaerythritol with the monocarboxylic acid (in which the content ratio of the behenic acid is from 60% by mass to 80% by mass; the content ratio of the arachidic acid is from 5% by mass to 15% by mass; and the content ratio of the stearic acid is from 15% by mass to 25% by mass).

According to Table 2, for Examples 1 to 7, the gloss value is 5.0 or more; the hot offset appearance temperature is 200° C. or more; the minimum fixing temperature is 150° C. or less; the dissipation start temperature is 205° C. or more; and the bleeding rate is 0%.

Therefore, it was revealed that by using the ester wax produced by the esterification reaction of the pentaerythritol and the monocarboxylic acid (in which the content ratio of the behenic acid is from 60% by mass to 80% by mass; the content ratio of the arachidic acid is from 5% by mass to 15% by mass; and the content ratio of the stearic acid is from 15% by mass to 25% by mass) in the toner, the toner (Examples 1 to 7) is excellent in low-temperature fixability and heat-resistant shelf stability, the glossiness is more improved than ever before, and the generation of ultrafine particles and the bleeding of the wax are not likely to occur.

The invention claimed is:

1. A wax for toners for developing electrostatic images,
wherein the wax is an ester wax generated by esterification of a pentaerythritol and a monocarboxylic acid;
wherein the monocarboxylic acid used for the esterification contains a behenic acid, an arachidic acid and a stearic acid; and
wherein, with respect to 100% by mass of the monocarboxylic acid, a content ratio of the behenic acid is from 60% by mass to 80% by mass; a content ratio of the arachidic acid is from 5% by mass to 15% by mass; and a content ratio of the stearic acid is from 15% by mass to 25% by mass.

2. A toner for developing electrostatic images, comprising colored resin particles containing a binder resin, a colorant and a wax,
wherein, as the wax, the toner contains the wax for toners for developing electrostatic images defined by claim 1.

3. The toner for developing electrostatic images according to claim 2, wherein, as the wax, the toner further contains a hydrocarbon wax.

4. The toner for developing electrostatic images according to claim 3,
wherein the hydrocarbon wax contains two or more kinds of wax molecules;
wherein a wax molecule contained the most in the hydrocarbon wax has from 35 to 55 carbon atoms; and
wherein a melting point of the hydrocarbon wax is from 60° C. to 85° C.

5. The toner for developing electrostatic images according to claim 3, wherein the hydrocarbon wax is a paraffin wax.

6. The toner for developing electrostatic images according to claim 2, wherein a content of the wax is from 5 parts by mass to 30 parts by mass, with respect to 100 parts by mass of the binder resin.

7. The toner for developing electrostatic images according to claim 2, wherein a ½ outflow temperature $T_{1/2}$ of the toner for developing electrostatic images measured by a flow tester, is from 125° C. to 135° C., and wherein a volume average particle diameter Dv of the toner for developing electrostatic images is from 5.5 μm to 6.5 μm, and a particle size distribution Dv/Dp of the toner is from 1.10 to 1.16.

* * * * *